US006383044B1

(12) United States Patent
Nemoto et al.

(10) Patent No.: US 6,383,044 B1
(45) Date of Patent: May 7, 2002

(54) OUTBOARD MOTOR

(75) Inventors: Hideki Nemoto; Shoichi Rinzaki, both of Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 09/938,365

(22) Filed: Aug. 24, 2001

(30) Foreign Application Priority Data

Aug. 25, 2000 (JP) ..... 2000-256296
Aug. 25, 2000 (JP) ..... 2000-256383

(51) Int. Cl.[7] ..... B63H 20/32
(52) U.S. Cl. ..... 440/77; 123/195 P; 440/900
(58) Field of Search ..... 123/195 P, 198 E, 123/195 C; 440/900, 88, 77

(56) References Cited

U.S. PATENT DOCUMENTS 5,370,563 A * 12/1994 Yamazaki et al. ..... 440/77
6,125,827 A * 10/2000 Wada et al. ..... 123/516

FOREIGN PATENT DOCUMENTS

JP 06033790 8/1994

* cited by examiner

*Primary Examiner*—Ed Swinehart
(74) *Attorney, Agent, or Firm*—Adams & Wilks

(57) ABSTRACT

An outboard motor according to the present invention has a generator. The outboard motor has a first passage for supplying air from above the generator and a second passage for supplying air from below the generator, so as to cool the generator. The first and second passages communicate with an air inlet opening provided in a front surface of an engine cover in a position below the generator.

8 Claims, 4 Drawing Sheets

30
S1
36
26
23
25
S2
25a
1
24
30c
41
22c
S7
S3
22d
41d
22e
S5
22
37
39
S6
37a
41g
43
38
21
S4

30
35a
35a'
S1
S8
36
25
26
S2
1
24
23
22c
S7
41
22d
S3
22e
S6
37
39
37a
S5
22
43
21
S4

OUTBOARD MOTOR

BACKGROUND OF THE INVENTION

1. Field of the Invention:

The present invention relates to an outboard motor in which an alternating-current generator or an alternator arranged inside an engine cover can be cooled effectively.

2. Description of the Related Art:

Generally, an outboard motor consists of an engine with a crankshaft disposed vertically, auxiliary machinery and equipment for the engine, and an engine cover covering the engine and the auxiliary machinery and equipment for the engine. The engine cover gives the appearance of the outboard motor.

To the engine is attached an alternating-current generator or an alternator (hereinafter referred to simply as generator) which is driven by the crankshaft through a belt/pulley mechanism. The generator is one of heat sources, and heat liberated by the generator becomes a cause of increased atmospheric temperature in an engine room defined by the engine cover of the outboard motor. The increased atmospheric temperature in the engine room can lead to increased temperature of intake air, resulting in degradation of engine performance. It is thus preferred to cool the generator.

An outboard motor disclosed in, for example, Japanese Patent Laid-Open Publication No. HEI-6-33790, has a generator covered by an engine cover. The generator is, however, provided simply in an engine room and is not cooled. Heat produced by the generator is dissipated in the engine room inside the engine cover, and increases atmospheric temperature in the engine room. Further, in this outboard motor, the generator covered by the cover without being cooled is arranged in the vicinity of a surge tank connected to an intake manifold and a throttle, which may increase temperature of intake air.

Furthermore, the generator provided in the outboard motor according to Japanese Patent Laid-Open Publication No. HEI-6-33790 is covered by the cover that is waterproofed. Hot air dissipated by the generator being driven while the engine is driven, is therefore prevented from being released outside even after a stop of the engine, so that atmospheric temperature in the engine room is not decreased.

SUMMARY OF THE INVENTION

It is an object of the present invention to provide an outboard motor which can effectively cool a generator attached to an engine with a simple structure and reliably separate water when letting in air for cooling in such a circumstance as on the sea.

According to an aspect of the present invention, there is provided an outboard motor comprising: an engine with a crankshaft disposed vertically; a generator disposed on the side of the engine and driven via a belt by the crankshaft, the generator having a plurality of slits in its upper and lower portions for letting cooling air in therethrough; an engine cover defining at least part of an engine room housing the engine, and having a front surface, two side surfaces and a top surface integrated with the two side surfaces; an opening provided in the front surface of the engine cover, positioned below the generator in the engine cover, for establishing communication between the inside of the engine cover and the air outside; a first passage provided in the engine cover, communicating with the opening and extending upwards from the position of the opening, for supplying the air from above the generator; and a second passage extending downwards from the position of an upper portion of the first passage, for supplying the air below the generator.

In this arrangement, the first passage for supplying air from above the generator and the second passage for supplying air from below the generator supply cooling air into the upper and lower slits of the generator. The generator being a heat source arranged inside the engine cover of the outboard motor is therefore efficiently cooled.

Desirably, a water separation chamber is further formed in a communicating hole between the first passage and the second passage, for making water and drops of water taken in with the air from the opening, fall. In the outboard motor operated on the waves or with water splashes, water and drops of water enter the inside of the engine cover together with air for cooling the generator, taken in through the opening of the front surface of the engine cover. The water and drops of water are separated from the air in the water separation chamber and made to fall, being prevented from reaching the generator with the air.

In a specific form, the water separation chamber comprises a vertical wall constituting part of a recess having part of the front surface of the engine cover recessed inwards, and a front cover for covering the recess. Since the water separation chamber is formed with the part of the engine cover and the front cover, it can be constructed simply. The front cover is, in an embodiment, for example, screwed to the engine cover in a direction perpendicular to a plane extended between the upper end and the lower end of the front cover.

According to another aspect of the present invention, there is provided an outboard motor comprising: an engine with a crankshaft disposed vertically; a generator driven by the crankshaft via a pulley and a belt; and a belt cover for covering the upper side of the generator, the belt cover having a first opening arranged above and opposed to the pulley of the generator.

In the outboard motor thus arranged, hot air emitted from the generator in operation and left after the engine stops is speedily discharged upwards through the first opening of the belt cover. Thus after a stop of the generator, hot air is prevented from being stagnated around the generator, and the generator and peripheral devices are prevented from being subjected to the effect of heat.

Desirably, the outboard motor further comprises an engine cover having a top surface defining at least part of an engine room housing the engine, for covering an upper portion of the engine, and a front surface continuing from the top surface, the top surface having a second opening formed in a position above the first opening formed in the belt cover. Since the second opening communicating with the first opening is formed in the engine cover, hot air is speedily discharged outside the engine cover.

It is preferred that the front surface of the engine cover has a recess recessed inwards; and the second opening is formed in a step formed in the recess; the second opening comprising a duct having a part extending upwards from a bottom surface of the step. The upwardly extended part separates air and water when the air is taken in, preventing water invasion.

Desirably, the outboard motor further comprises a front cover for covering the recess of the engine cover, the front cover having a plurality of openings in a position lower than the bottom surface of the step, for taking in air therethrough, thereby letting in a sufficient amount of air.

A water drainage may be provided in a position below the bottom surface of the step, thereby speedily draining water entering with air let in.

BRIEF DESCRIPTION OF THE DRAWINGS

Certain preferred embodiments of the present invention will be described in more detail below, by way of example only, with reference to the accompanying drawings, in which.

DETAILED DESCRIPTION OF THE PREFERRED EMBODIMENTS

Figure 1:
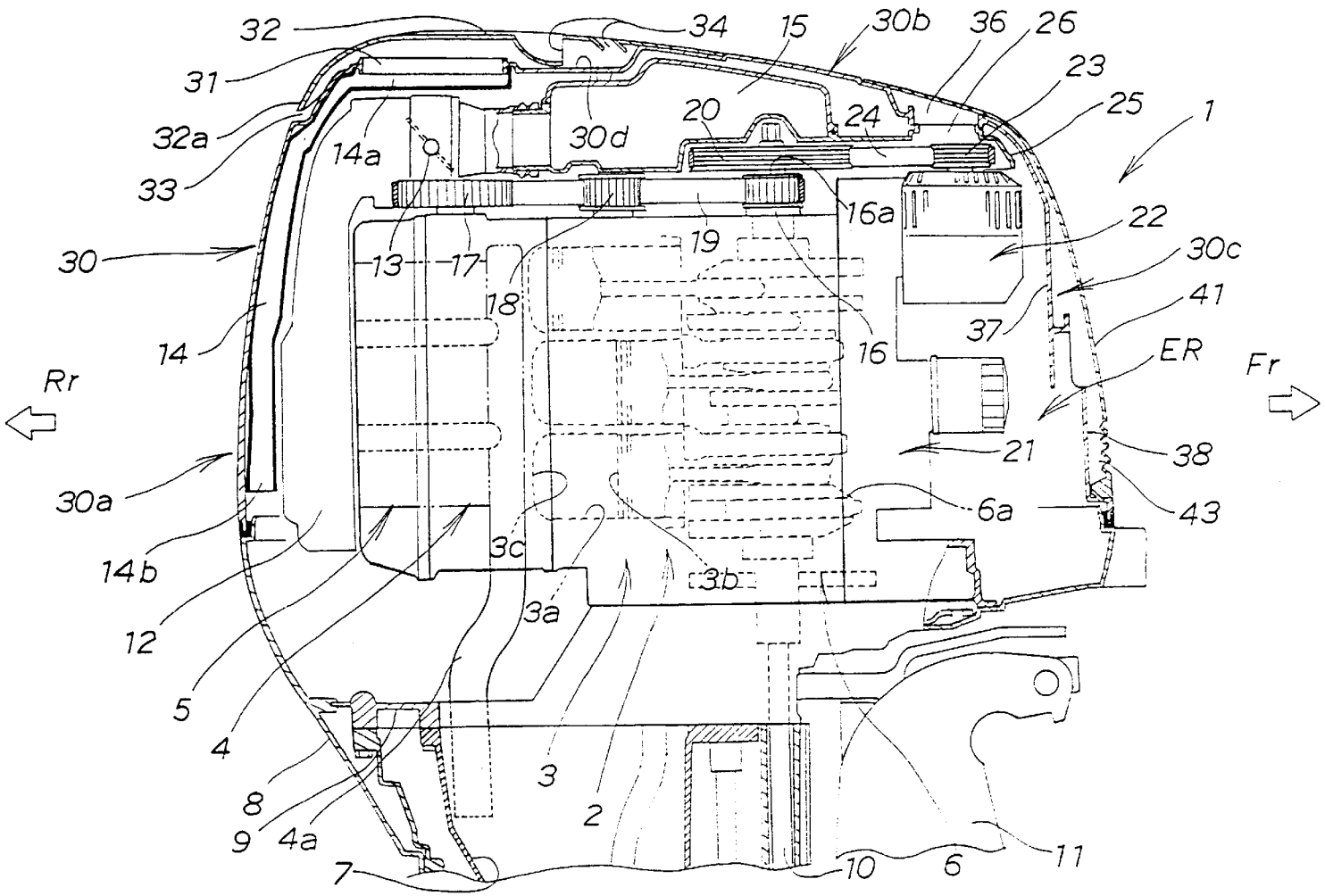
FIG. 1 is a sectional view illustrating an upper part of an outboard motor according to the present invention.

In FIG. 1, reference character Fr designates a forward direction of an outboard motor while reference character Rr designates a rearward direction of the motor.

As shown in FIG. 1, an outboard motor 1 has in its upper part an engine 2 disposed horizontally. The engine 2 in this embodiment has two cylinder blocks 3 (only one shown in FIG. 1). Each cylinder block 3 has a plurality of cylinders 3*a* disposed horizontally and arranged vertically. A piston 3*b* is fitted into each cylinder 3*a*. A cylinder head 4 is connected to the front end (on the Rr side of the outboard motor 1) of the cylinder block 3. A cylinder head cover 5 is similarly provided at the front end of the cylinder head 4. A crankcase 21 is connected to the rear ends of the cylinder blocks 3 (on the Fr side of the outboard motor 1). The cylinders 3*a* of the cylinder blocks 3 and the cylinder heads 4 form a plurality of combustion chambers 3*c*.

A skirt 6 housing a crankshaft 6*a* disposed vertically is integrally formed with rear portions of the cylinder blocks 3. The skirt 6 constitutes generally one-half of a crank room. The crankcase 21 constitutes the other half of the crank room. An oil pan 7 is arranged below the cylinder blocks 3 and skirt 6.

In this embodiment, the engine 2 is a V-6 engine with the cylinder blocks 3 arranged in a V configuration in a plan view.

The engine 2 is supported on a mounting case 9 provided inside of an under cover 8. An exhaust pipe 4*a* extends downwards from an exhaust manifold provided on the side of the cylinder head 4. The lower end of the exhaust pipe 4*a* extends into an extension case (not shown) positioned below the mounting case 9, and discharges exhaust gas.

The lower end of the crankshaft 6*a* is connected to a drive shaft 10 extending vertically. The drive shaft 10 extends through the extension case not shown downwards and is connected to a screw not shown via a gearbox not shown.

A stern bracket 11 is provided at a front portion of the mounting case 9. Via the stern bracket 11, the outboard motor 1 is mounted to a stern.

An intake manifold 12 is provided rearwards of the cylinder head covers 5 (on the Rr side of the outboard motor 1 in FIG. 1). The intake manifold 12 distributes and supplies fuel to the cylinders of the engine. The intake manifold 12 is connected to a throttle valve device 13 disposed above the cylinder head 4 in the figure.

An air intake guide 14 is provided rearwards of the intake manifold 12. The guide 14 is formed independently of the engine cover. An intake silencer 15 is disposed over the top surfaces of the cylinder blocks 3 and the skirt 6 of the engine 2.

Above the engine 2, a drive pulley 16 driven by the crankshaft 6*a* is provided. Above the cylinder heads 4, a camshaft pulley 17 is provided. A timing belt 19 is wound around the pulleys 16 and 17 via a middle pulley 18.

On the shaft 16*a* of the drive pulley 16 driven by the crankshaft 6*a*, a generator drive pulley 20 is coaxially provided. A belt 24 is wound around the pulley 20 and a driven pulley 23 of the generator 22.

At the rear end of the skirt 6 of the engine 2 (on the Fr side of the outboard motor 1), the crankcase 21 is provided. The generator 22 is mounted to an upper part of the crankcase 21 to project forwards in the Fr direction of the outboard motor 1.

The surroundings of the engine 2 are covered by the engine cover 30 which defines the engine room ER inside.

The engine cover 30 includes a rear surface 30*a*, two side surfaces not shown (on the right and left sides in the forward direction Fr of the outboard motor 1), a top surface 30*b* and a front surface 30*c*, and opens downwards to be joined with the upper end of the under cover 8.

In an upper rear surface of the engine cover 30, an air intake opening 31 is provided. The opening 31 is connected to an upper end opening 14*a* of the air intake guide 14. A lower end opening 14*b* of the guide 14 faces downwards. A rear part of the top surface 30*b* including the opening 31 forms a recess 30*d* set back downwards in a step and is covered with a top cover 32.

A space is formed between the top cover 32 and the recess 30*d*. An air intake slit 33 is formed between a rear end 32*a* of the top cover 32 and a top part of the rear surface 30*a*. Air intake slits 34 are formed in a top surface of the top cover 32.

An air intake opening and passage for cooling the generator is provided in the front surface 30*c* of the engine cover 30.

Figure 2:
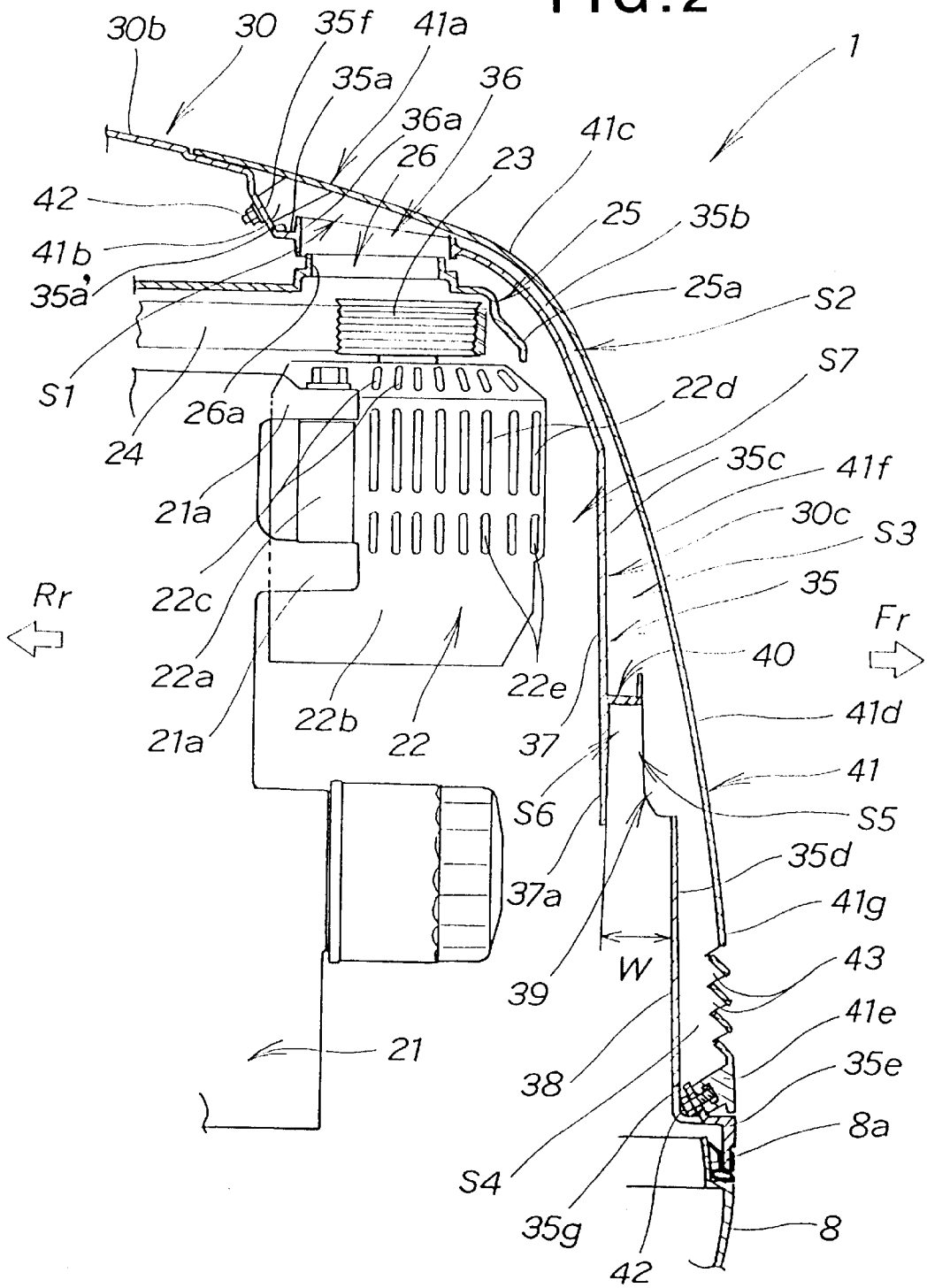
FIG. 2 is an enlarged sectional view illustrating a front part of the outboard motor.

In FIG. 2, the generator 22 is fixed between two supporting bosses 21*a*, 21*a* in a fork shape extending forwards (to the right in the figure) from an upper part of the crankcase 21, via a stay 22*a*.

The generator 22 has a body 22*b* which includes, in its upper periphery near the pulley 23 above, a plurality of upper slits 22*c* for letting cooling air in therethrough, and in its middle periphery a plurality of middle slits 22*d* for letting cooling air out therethrough, and in its lower periphery a plurality of lower slits 22*e* for letting cooling air in therethrough.

Above the generator 22, is provided a belt cover 25 for covering the driven pulley 23, belt 24 and drive pulley 20. The belt cover 25 has a front part 25*a* of a semicircular shape in a plan view, which has a first opening 26 in its upper part. The opening 26 is formed with an annular bank 26*a* standing upright from an upper surface of the belt cover 25. The opening 26 is arranged above the pulley 23 of the generator 22 and inside of the outer periphery of the pulley 23. The generator 22 is placed close to an upper part of the front surface 30*c* of the engine cover 30. The front surface 30*c* of the engine cover 30 is formed with a recess 35 set back inwards (in the Rr direction of the outboard engine 1).

The recess 35 includes a step 35*a* lowered in a front part of the top surface 30*b* of the engine cover 30, a curved part 35*b* extending forwards from the front part of the step 35 and curving downwards continuously, an upper vertical wall 35*c* extending downwards from the curved part 35*b* in the vertical direction, and a lower vertical wall 35*d* protruding forwards at the vertically middle part of the front surface 30*c* below the upper vertical wall 35*c*. A lower end part 35*e* of the lower vertical wall 35*d* is bent in an L shape and fitted onto an upper end step 8*a* of the under cover 8.

A mounting wall 35*f* extends obliquely in a rear upward direction from the rear end of the step 35*a* as an upper part of the recess 35. The L-shaped lower end part 35*e* of the lower vertical wall 35*d* has a mounting wall 35*g* extending obliquely in a rear upward direction.

The step 35*a* provided in an upper part of the recess 35 has a second opening 36 in a duct shape. The opening 36 is formed with an annular bank 36*a* serving as a duct, extending upward from a bottom surface 35*a*' of the step 35*a*. The opening 36*a* has a diameter larger than that of the opening 26 directly below provided in a front part of the belt cover 25. The opening 36 and the opening 26 are arranged adjacently to communicate with each other in the vertical direction.

An upper vertical wall part 37 constituting the upper vertical wall 35*c* of the recess 35 is opposed to the front of the generator 22 with a space therebetween. A lower half 37*a* of the upper vertical wall part 37 extends below the generator 22.

A lower vertical wall part 38 constituting the lower vertical wall 35*d* of the front surface 30*c* is opposed at its upper part to the front surface of the lower half 37*a* of the vertical wall part 37 with a space W therebetween.

The upper part of the lower vertical wall part 38 opposed to the lower half 37*a* of the upper vertical wall part 37 is provided with a communicating hole 39 extending therethrough in the cross direction. A gutter 40 in a reverse L shape is projected forwards from the vertically middle part of the upper vertical wall part 37, constituting a ceiling at the upper end of the communicating hole 39.

The recess 35 provided in the front surface 30*c* of the engine cover 30 is covered with a front cover 41. The front cover 41 is L shaped with a curved cross section. At an end part of an upper front part 41*a* of the front cover 41 extending forwards, is provided a mounting boss 41*b* slanting rearwards and downwards. The boss 41*b* is fastened to the upper mounting wall 35*f* via a screw 42. At a lower end part of a front wall 41*d* of the front cover 41 extending vertically downwards from a curved part 41*c*, is provided a mounting boss 41*e* slanting inwards (rearwards) and downwards. The boss 41*e* is fastened to the lower mounting wall 35*g* via a screw 42.

As described above, the front cover 41 is mounted on the front surface 30*c* of the engine cover, to cover the recess 35. The screwed parts of the front cover 41 are substantially perpendicular to a plane extending between the upper end and the lower end of the front cover.

A front wall 41*d* of the front cover 41 has a plurality of openings 43 formed at its lower part 41*g*. The openings 43 are, in this embodiment, a plurality of slits in a louver shape, arranged in the vertical direction.

The upper front part 41*a* of the front cover 41 covers the upper side of the step 35*a* including the annular opening 36, to form a space S1 between the upper front part 41*a*, opening 36 and the surrounding.

An uppermost passage S2 made of a space with a narrow width is formed between the inner surface of the curved part 41*c* of the front cover 41 and the curved part 35*b* of the engine cover 30. An intermediate passage S3 is formed between an upper half 41*f* of the front wall 41*d* and the upper vertical wall 35*c* (upper vertical wall part 37). The passage S3 is gradually narrowed in the upward direction.

A lower passage S4 is formed between a lower part 41*g* of the front cover 41 and the lower vertical wall 35*d* (lower vertical wall part 38) spaced rearwards from the lower part 41*g*. Above the lower passage S4, a communicating passage S5 is formed with the communicating hole 39.

The lower half 37*a* of the upper vertical wall part 37 forming the communicating passage S5 in its set-back position constitutes a bottom wall of the passage S5, serving as a water separation wall. Thus a water separation chamber S6 is formed in front of the lower half 37*a*, being closed at its upper part with the gutter 40. An inside passage S7 is formed between the front of the generator 22 and the upper vertical wall part 37.

As shown in FIG. 1, the cross-sectional area of a passage between the intake opening 31 and the upper opening 14*a* of the air intake guide 14, corresponding to a substantial intake opening for the engine room, is larger than the cross-sectional area of a passage of the slits 43 formed in the front surface 30*c* of the engine cover 30, thereby supplying a larger amount of intake air for combustion to the combustion chambers, decreasing the temperature of the intake air.

Now the flow of cooling air for the generator caused by air intake is described with reference to FIG. 3.

Figure 3:
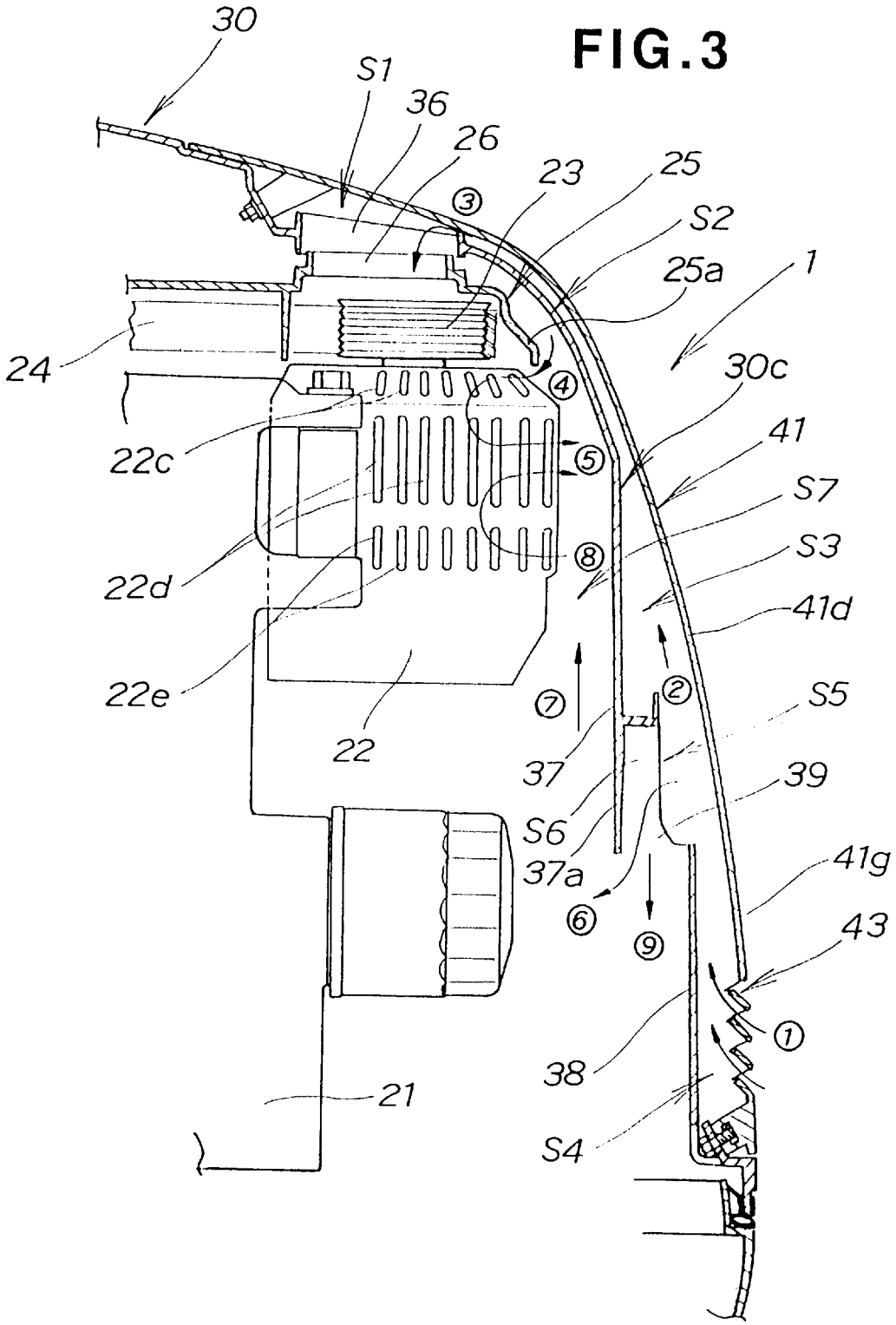
FIG. 3 is a sectional view illustrating the flow of air taken in for cooling a generator.

In FIG. 3, air is taken from the slits 43 formed in the lower part 41*g* of the front cover 41 into the lower passage S4 between the lower part 41*g* of the front wall 41*d* and the lower vertical wall part 38 of the front surface 30*c* of the engine cover 30, as shown by arrow ①. The lower passage S4 communicates with the intermediate passage S3 above. The passages S4 and S3 constitute a first passage. The intake air flows upwards in the direction of arrow ②, passes through the uppermost passage S2, and through the opening 36 and the opening 26 as shown by arrow ③, flows downwards from above the pulley 23 of the generator 22.

Since the diameter of the opening 26 is smaller than that of the duct-shaped opening 36, the cooling air flows through the gap therebetween into the outside of the front part 25*a* of the belt cover 25 in a semicircular roof-like shape, as shown by arrow ④. The cooling air is taken from the upper slits 22*c* for letting cooling air in therethrough, arranged in the upper periphery of the generator 22, into the inside of the generator 22, thereby cooling the generator 22. Exhaust air after cooling is let out from the slits 22*d* formed in the middle periphery of the generator 22 as shown by arrow ⑤.

Part of air taken into the lower passage S4 in the first passage goes through the passage in front of the lower half 37*a* of the upper vertical wall part 37 through the communicating passage S5 constituted with the communicating hole 39, turns around a lower part of the lower half 37 as shown by arrow ⑥, and goes up a second passage constituted with the inside passage S7 along the upper vertical wall part 37 as shown by arrow ⑦.

The cooling air going up as shown by arrow ⑦ is taken from the lower slits 22*e* of the generator 22 above, into the inside of the generator 22 as shown by arrow ⑧. Exhaust air after cooling is let out from the slits 22*d* in the middle section as shown by arrow ⑤.

Since the outboard motor is used on the sea or water, it may let water or drops of water in while letting air in from the openings 43 because of turbulence or the like. Water and drops of water in air taken into the lower passage S4 are not conveyed upward but are taken from the communicating hole 39 (communicating passage S5) provided in a lower level into the space in front of the lower half 37*a* of the upper vertical wall part 37. The lower half 37*a* blocks the flow thereof. The space formed with the lower half 37*a* serves as the water separation chamber S6 and makes the invading water and drops of water fall as shown by arrow ⑨, thereby eliminating them from the cooling air.

Thus, water and drops of water included in air taken into the outboard motor 1 are removed and do not reach the generator 22 with the cooling air for the generator 22.

Figure 4:
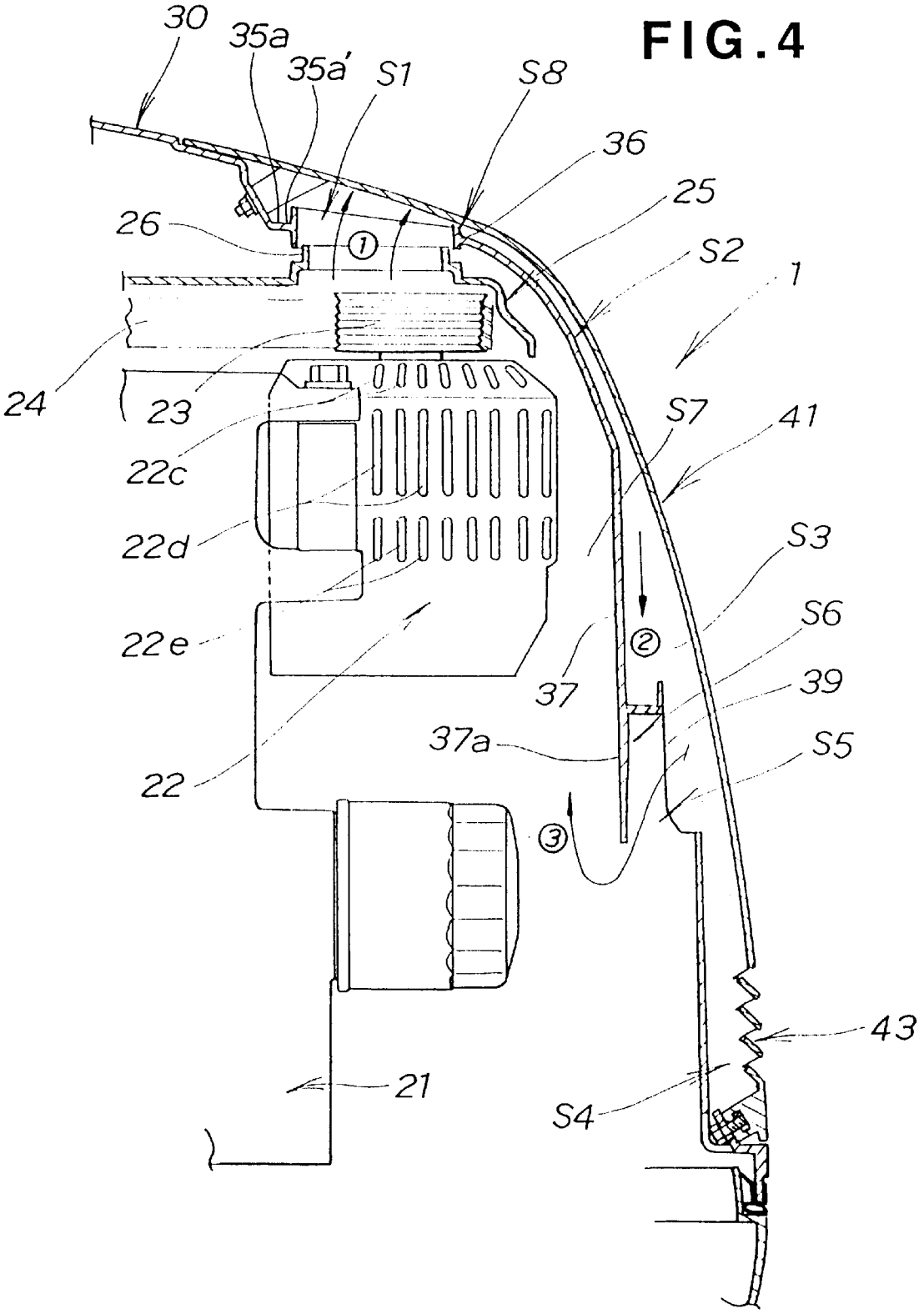
FIG. 4 is a sectional view illustrating the flow of exhaust air heated by the generator after an engine is stopped.

Now the flow of hot air after the generator 22 stops operating is described with reference to FIG. 4.

Hot air produced by the generator 22 in operation is emitted around the generator 22 when the generator 22 stops. Since the belt cover 25 covering the upper side of the pulley 23 of the generator 22 has the opening 26 in a position above the generator 22, hot air emitted by the generator 22 goes up as shown by arrow ① and is discharged upwards from the annular opening 36 of the engine cover 30 above. Thus, since the upper portion of the generator is not completely covered, unlike a conventional outboard motor, hot air is not stagnated inside the belt cover 25.

Hot air discharged upwards from the openings 26, 36 as shown by arrow ① flows from the space S1 through a thin communicating passage S8 in an upper portion of the uppermost passage S2 into the passage S2, passes the intermediate passage S3, and then flows into the lower passage S4 or flows out inside the engine cover 30 as shown by arrow ③ through the communicating passage S5, thereby cooling the generator speedily after a stop of its operation.

In the present invention, since the duct-shaped opening 36 is arranged in a higher position than the bottom surface 35*a*' of the step 35*a*, water invasion into the opening 36 is prevented, and water invasion from the opening 26 formed in the belt cover 25 into the inside of the outboard motor 1 is prevented.

Obviously, various minor changes and modifications of the present invention are possible in the light of the above teaching. It is therefore to be understood that within the scope of the appended claims the invention may be practiced otherwise than as specifically described.

What is claimed is:

1. An outboard motor comprising:

an engine with a crankshaft disposed vertically;

an alternating-current generator disposed on the side of said engine and driven via a belt by said crankshaft, said generator having a plurality of slits in its upper and lower portions for letting cooling air in therethrough;

an engine cover defining at least part of an engine room housing said engine, and having a front surface, two side surfaces and a top surface integrated with the two side surfaces;

an opening provided in the front surface of said engine cover, positioned below said generator in said engine cover, for establishing communication between the inside of said engine cover and the air outside;

a first passage provided in said engine cover, communicating with said opening and extending upwards from the position of said opening, for supplying the air from above said generator; and a second passage extending downwards from the position of an upper portion of said first passage, for supplying the air below said generator.

2. An outboard motor as set forth in claim 1, wherein:

a water separation chamber is formed in a communicating hole between said first passage and said second passage, for making water and drops of water taken in with the air from said opening, fall.

3. An outboard motor as set forth in claim 2, wherein:

said water separation chamber comprises a vertical wall constituting part of a recess having part of said front surface of said engine cover recessed inwards, and a front cover for covering said recess.

4. An outboard motor comprising:

an engine with a crankshaft disposed vertically;

a generator driven by said crankshaft via a pulley and a belt; and a belt cover for covering the upper side of said generator, said belt cover having a first opening arranged above and opposed to said pulley of said generator.

5. An outboard motor as set forth in claim 4, further comprising:

an engine cover having a top surface defining at least part of an engine room housing said engine, for covering an upper portion of said engine, and a front surface continuing from said top surface, said top surface having a second opening formed in a position above said first opening formed in said belt cover.

6. An outboard motor as set forth in claim 5, wherein:

said front surface of said engine cover has a recess recessed inwards; and said second opening is formed in a step formed in said recess; said second opening comprising a duct having a part extending upwards from a bottom surface of said step.

7. An outboard motor as set forth in claim 6, further comprising:

a front cover for covering said recess of said engine cover, said front cover having a plurality of openings in a position lower than the bottom surface of said step, for taking in air therethrough.

8. An outboard motor as set forth in claim 6, wherein:

a water drainage is provided in a position below the bottom surface of said step.

* * * * *